US012123411B2

(12) United States Patent
Hisano et al.

(10) Patent No.: US 12,123,411 B2
(45) Date of Patent: Oct. 22, 2024

(54) LIQUID-COOLED ROTARY COMPRESSOR AND COOLANT SUPPLY METHOD THEREFOR

(71) Applicant: Hitachi, Ltd., Tokyo (JP)

(72) Inventors: Nae Hisano, Tokyo (JP); Ryota Iijima, Tokyo (JP); Kotaro Chiba, Tokyo (JP); Takeshi Tsuchiya, Tokyo (JP)

(73) Assignee: HITACHI, LTD., Tokyo (JP)

( * ) Notice: Subject to any disclaimer, the term of this patent is extended or adjusted under 35 U.S.C. 154(b) by 0 days.

(21) Appl. No.: 18/121,630

(22) Filed: Mar. 15, 2023

(65) Prior Publication Data

US 2023/0383749 A1 Nov. 30, 2023

(30) Foreign Application Priority Data

May 26, 2022 (JP) ..... 2022-086079

(51) Int. Cl.
*F04C 2/16* (2006.01)
*F04C 15/00* (2006.01)
(Continued)

(52) U.S. Cl.
CPC ..... *F04C 15/0096* (2013.01); *F04C 2/16* (2013.01); *F04C 18/16* (2013.01);
(Continued)

(58) Field of Classification Search
CPC ..... F04C 15/0096; F04C 2/16; F04C 18/16; F04C 29/0014; F04C 29/021;
(Continued)

(56) References Cited

U.S. PATENT DOCUMENTS 4,035,114 A * 7/1977 Sato ..... F04C 29/026 418/97
4,289,461 A * 9/1981 van Oorschot ..... F04C 29/0014 418/97

(Continued)

FOREIGN PATENT DOCUMENTS

JP 08-042476 A 2/1996

OTHER PUBLICATIONS

JP2010243011A—Morita et al.—Cold Water Manufacturing Device—Oct. 28, 2010—the English Machine Translation. (Year: 2010).*

*Primary Examiner* — Theresa Trieu
(74) *Attorney, Agent, or Firm* — MATTINGLY & MALUR, PC

(57) ABSTRACT

A liquid-cooled rotary compressor includes a compressor main body having a compression chamber formed by a fixed wall and a rotating wall and compressing gas, and a liquid injection path for injecting a coolant into the compression chamber, and adjusts a discharge flow rate by changing a rotational speed of the rotating wall. The compressor includes a liquid amount adjusting unit that adjusts an amount of the coolant supplied from the liquid injection path to the compressor main body according to a change in the rotational speed of the rotating wall, and a compressed gas supply path that supplies compressed gas to a downstream side of the liquid amount adjusting unit in the liquid injection path. The compressed gas is supplied from the compressed gas supply path to the liquid injection path according to the amount of the coolant supplied to the compressor main body.

10 Claims, 6 Drawing Sheets

(51) Int. Cl.
*F04C 18/16* (2006.01)
*F04C 29/00* (2006.01)
*F04C 29/02* (2006.01)

(52) U.S. Cl.
CPC ..... *F04C 29/0014* (2013.01); *F04C 29/021* (2013.01); *F04C 29/028* (2013.01); *F04C 2270/205* (2013.01)

(58) Field of Classification Search
CPC .... F04C 29/026; F04C 29/028; F04C 29/042; F04C 2270/205
See application file for complete search history.

(56) References Cited

U.S. PATENT DOCUMENTS

| | | | | |
|---|---|---|---|---|
| 6,474,953 | B2 * | 11/2002 | Van De Putte | F04C 28/00 417/44.2 |
| 2017/0130720 | A1 * | 5/2017 | Yorikane | F04C 29/021 |
| 2017/0298937 | A1 * | 10/2017 | Seghers | F04C 29/021 |

* cited by examiner

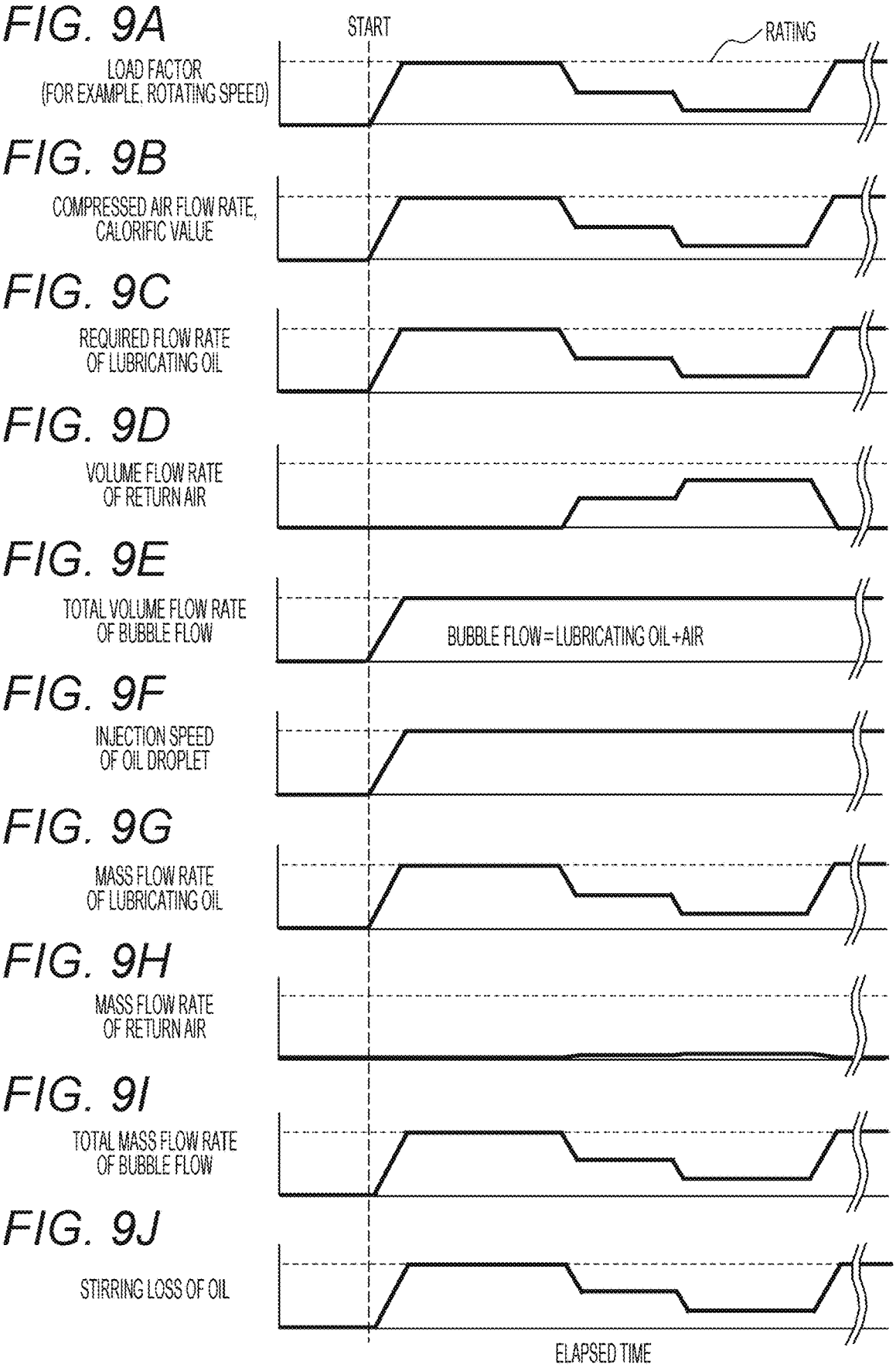
FIG. 9A
LOAD FACTOR
(FOR EXAMPLE, ROTATING SPEED)
START
RATING
FIG. 9B
COMPRESSED AIR FLOW RATE,
CALORIFIC VALUE
FIG. 9C
REQUIRED FLOW RATE
OF LUBRICATING OIL
FIG. 9D
VOLUME FLOW RATE
OF RETURN AIR
FIG. 9E
TOTAL VOLUME FLOW RATE
OF BUBBLE FLOW
BUBBLE FLOW = LUBRICATING OIL + AIR
FIG. 9F
INJECTION SPEED
OF OIL DROPLET
FIG. 9G
MASS FLOW RATE
OF LUBRICATING OIL
FIG. 9H
MASS FLOW RATE
OF RETURN AIR
FIG. 9I
TOTAL MASS FLOW RATE
OF BUBBLE FLOW
FIG. 9J
STIRRING LOSS OF OIL
ELAPSED TIME

LIQUID-COOLED ROTARY COMPRESSOR AND COOLANT SUPPLY METHOD THEREFOR

CROSS REFERENCE TO RELATED APPLICATIONS

This application claims priority to Japanese Patent Application No. JP 2022-086079 filed on May 26, 2022, the entire contents of which are incorporated by reference herein.

BACKGROUND OF THE INVENTION

1. Field of the Invention

The present invention relates to a liquid-cooled rotary compressor and a coolant supply method therefor, and is suitable for, for example, an oil-cooled screw compressor and a water injection screw compressor.

2. Description of the Related Art

A liquid-cooled rotary compressor is a machine that compresses a gas such as air in an internal space (compression chamber) surrounded by a fixed wall such as a casing and a rotating wall such as a rotor by a rotational force while narrowing the space, and slowly cools compression heat with a liquid (coolant) such as oil or water to take out the compressed gas. The coolant for slow cooling is injected from a liquid injection nozzle provided on an inner wall of the fixed wall forming the compression chamber, heated by heat exchange with the compressed gas and the rotating wall, discharged together with the gas (compressed gas) compressed from a compression chamber outlet (discharge port), and then separated from the compressed gas by a gas-liquid separator such as an oil separator. The separated liquid is subjected to heat exchange by a cooler to be cooled, and forms a circulation cycle of returning to the compression chamber.

When the coolant is oil (lubricating oil) and the gas to be compressed is air, an amount of heat to be removed by the oil as the coolant is proportional to an amount of air to be compressed. Therefore, when an operating condition of the compressor is operated at a rotational speed lower than that during a rated operation, it is possible to reduce a circulating liquid amount (circulating oil amount). When the amount (mass) of the liquid supplied to the compression chamber can be reduced, an acceleration work given to the coolant can be reduced by the rotational force of the compressor, so that power consumption is reduced.

As a known example related to this, JP 8-42476 A discloses that an amount of lubricating oil injected into an operating chamber (compression chamber) increases or decreases according to a rotational speed of a compressor.

SUMMARY OF THE INVENTION

In JP 8-42476 A, an amount of coolant injected into a compression chamber increases or decreases according to a rotational speed of a compressor. However, when the amount of coolant injected into the compression chamber decreases, an injection speed of the injected coolant is also decreases. When the injection speed of the coolant decreases, the coolant does not sufficiently reach a rotating wall surface (for example, wall surface of screw rotor) forming the compression chamber, and there is a problem that lubrication or sealing between the rotating wall surfaces (between the rotors) or between the rotating wall surface and a fixed wall surface, or slow cooling of the compressed gas cannot be sufficiently performed.

An object of the present invention is to obtain a liquid-cooled rotary compressor capable of suppressing a decrease in injection speed of a coolant even when an amount of coolant injected into a compression chamber decreases, and a coolant supply method therefor.

In order to achieve the above object, according to an aspect of the present invention, there is provided a liquid-cooled rotary compressor including a compressor main body that forms a compression chamber by a fixed wall and a rotating wall and a liquid injection path that injects a coolant into the compression chamber and adjusting a discharge flow rate by changing a load factor of the compressor main body, the liquid-cooled rotary compressor including: a liquid amount adjusting unit that adjusts an amount of the coolant supplied from the liquid injection path to the compressor main body according to a change in the load factor of the compressor main body; and a compressed gas supply path configured to supply compressed gas to a downstream side of the liquid amount adjusting unit in the liquid injection path, in which the compressed gas is supplied from the compressed gas supply path to the liquid injection path according to the amount of the coolant supplied to the compressor main body.

According to another aspect of the present invention, there is provided a coolant supply method for a liquid-cooled rotary compressor that injects a coolant from a liquid injection path into a compression chamber of the compressor, the coolant supply method including: controlling an amount of the coolant to be supplied to the compressor according to a load factor of the compressor; supplying a part of a compressed gas to the liquid injection path according to the amount of the coolant supplied to the compressor; and controlling a volume flow rate of a gas-liquid mixed fluid obtained by combining the coolant and the compressed gas to be substantially constant regardless of a load factor of the compressor, and supplying the gas-liquid mixed fluid to the compressor.

According to the present invention, there is an effect that it is possible to obtain a liquid-cooled rotary compressor capable of suppressing a decrease in an injection speed of the coolant even when the amount of the coolant injected into the compression chamber is reduced, and a coolant supply method therefor.

BRIEF DESCRIPTION OF THE DRAWINGS

FIGS. 9A to 9J are schematic time transition diagrams of a physical quantity for explaining a relationship between a change in a load factor in the liquid-cooled rotary compressor illustrated in FIG. 1 and a flow rate, a calorific value, and the like of compressed air.

DESCRIPTION OF THE PREFERRED EMBODIMENTS

Figure 1:
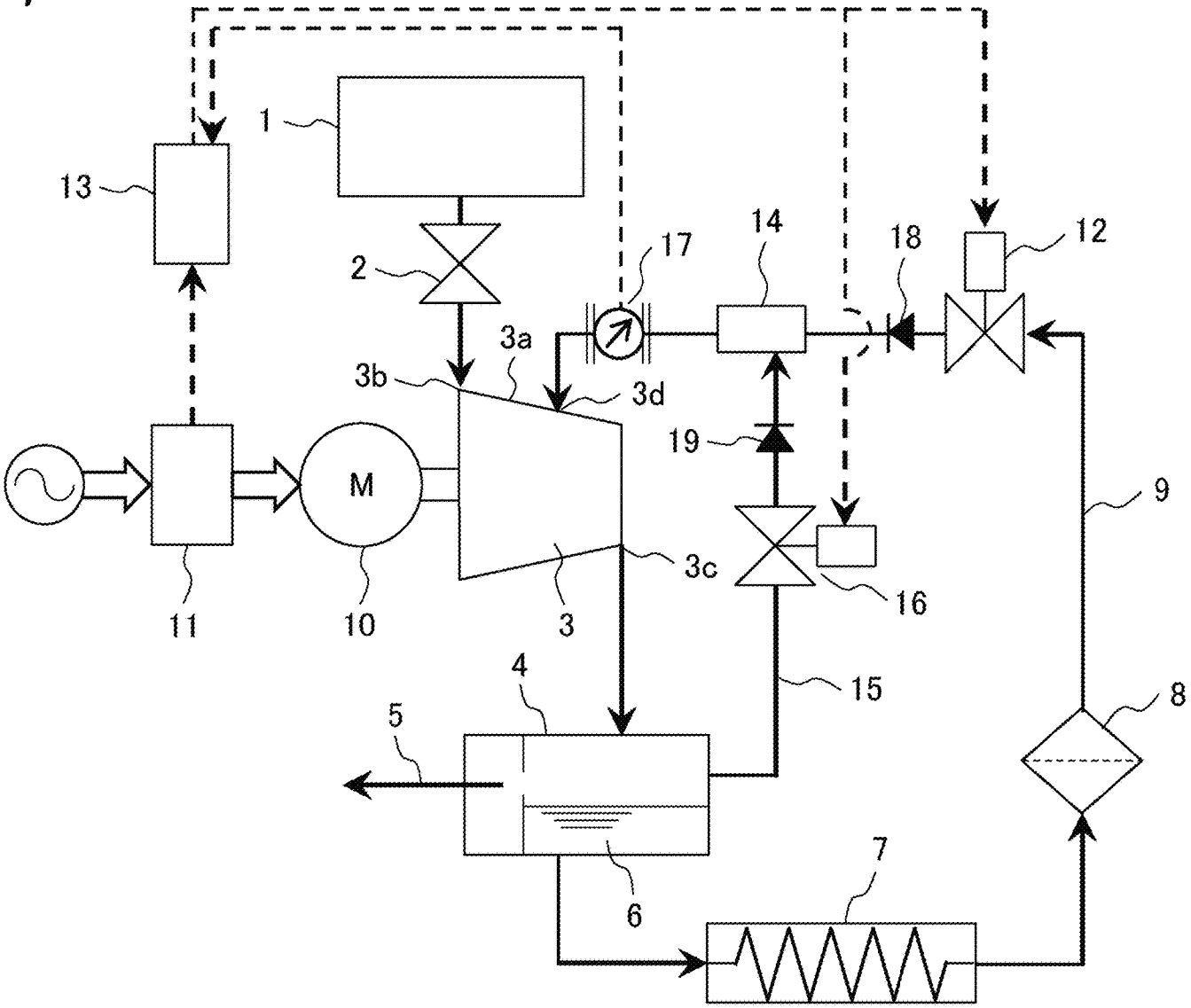
FIG. 1 is a diagram illustrating a first embodiment of a liquid-cooled rotary compressor of the present invention, and is a system diagram illustrating an overall configuration.

Hereinafter, specific examples of a liquid-cooled rotary compressor of the present invention will be described with reference to the drawings. In the drawings, the same reference numerals denote the same or corresponding parts.

First Embodiment

Figure 2:
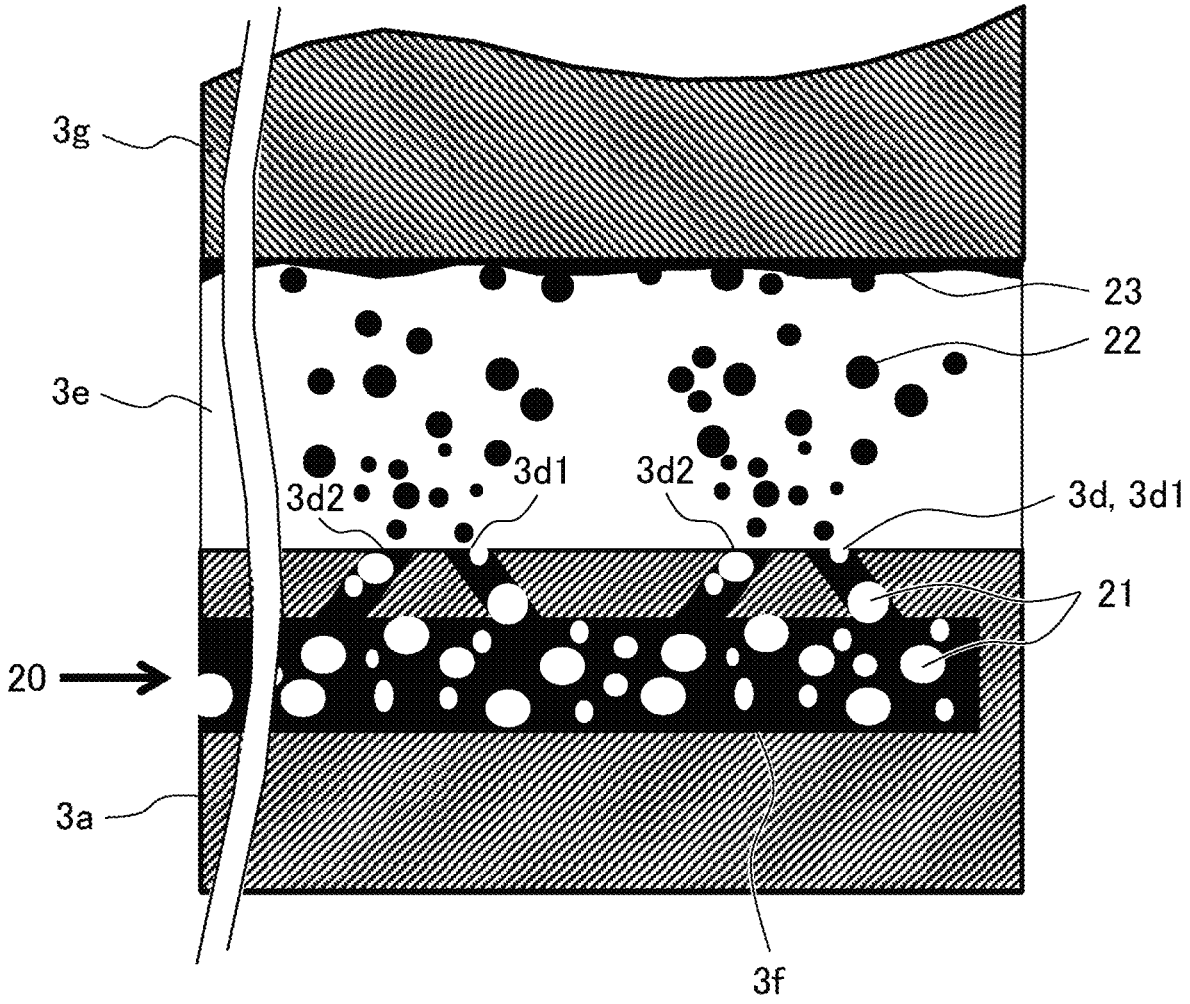
FIG. 2 is a cross-sectional view of a main part of a compressor main body in FIG. 1 and illustrates a situation where a bubble flow is injected from an injection port to a compression chamber.

FIG. 1 is a diagram illustrating a first embodiment of a liquid-cooled rotary compressor of the present invention, and is a system diagram illustrating an overall configuration, and FIG. 2 is a cross-sectional view of a main part of a compressor main body in FIG. 1, and is a diagram for explaining a situation in which a bubble flow is injected from an injection port to a compression chamber. In addition, in the present embodiment, a description will be given of a case where the liquid-cooled rotary compressor is an oil-cooled screw compressor that compresses air to produce compressed air.

As illustrated in FIG. 1, external air passes through an intake filter 1 and an intake throttle valve 2, and is sucked into a compressor main body (compressor) 3 from a suction port 3*b* provided in a casing (fixed wall) 3*a* of the compressor main body (compressor) 3. A screw rotor (rotor; a rotating wall) is provided inside the compressor main body 3, and the air is taken into a compression chamber formed by the casing and the screw rotor, compressed, and discharged from a discharge port 3*c* provided in the casing 3*a*. The casing 3*a* is provided with an injection port 3*d* for injecting lubricating oil (coolant) into the compression chamber, and the cooled lubricating oil is injected into the compression chamber. The lubricating oil injected into the compression chamber is mixed into the compressed air to perform lubrication and sealing of a gap between the screw rotors inside the compressor main body 3 and between the screw rotor and the casing 3*a*. In addition, the lubricating oil takes heat from the compressed air heated by compression heat generated in a compression step and the screw rotor to cool them.

A mixed fluid of the compressed air compressed to a predetermined pressure and the lubricating oil injected into the compression chamber is discharged from the discharge port 3*c*, and the mixed fluid flows into an oil separator (gas-liquid separator) 4 and is separated into the compressed air and the lubricating oil. The compressed air from which most of the lubricating oil is separated passes through a discharge flow path 5 such as a discharge pipe and is supplied to an application (demand destination) of the compressed air.

The lubricating oil 6 separated by the oil separator 4 enters an oil cooler (liquid cooler) 7 via a pipe, is cooled here, passes through an oil filter 8, passes through an oil supply pipe (liquid injection path) 9, and is injected from the injection port 3*d* of the compressor main body 3 into the compression chamber in an intermediate step of compression. That is, since the inside of the oil separator 4 has a substantially discharge pressure and the compression chamber in the compression intermediate step into which the lubricating oil is injected has a pressure lower than the discharge pressure, the lubricating oil is injected into the compression chamber by a differential pressure. The lubricating oil flows to form such a circulation path, and plays roles such as lubrication, sealing, and cooling of compressed air in the compressor main body 3.

A reference numeral 10 denotes an electric motor that drives a screw rotor of the compressor main body 3, and a reference numeral 11 denotes an inverter that frequency-converts electric power from a commercial AC power supply and supplies the electric power to the electric motor 10. The compressor is subjected to rotating speed control in accordance with a required air amount at a demand destination which needs compressed air. That is, the commercial AC power supplied from the outside is converted into a frequency and a voltage according to a load amount of the compressor by the inverter 11 and supplied to the electric motor 10. The compressor main body 3 changes a rotational speed (load factor) to adjust a discharge flow rate, and controls a discharge pressure to be substantially constant.

When the required air amount air at the demand destination increases and the rotating speed of the screw rotor of the compressor main body 3 increases, the amount of air sucked into and compressed by the compressor main body 3 increases, and accordingly, a large amount of compression heat is generated. On the contrary, when the rotating speed decreases, the generation of the compression heat decreases accordingly.

Therefore, in the present embodiment, a flow rate adjusting valve (first flow rate adjusting valve) 12 as a liquid amount adjusting unit is provided in the middle of the oil supply pipe (liquid injection path) 9, and a control device 13 that controls the flow rate adjusting valve 12 is provided.

The lubricating oil supplied to the compressor main body 3 functions as cooling, lubrication, and sealing. Since the mass of the lubricating oil is much larger than that of air, a stirring loss due to rotation of the screw rotor occurs. Therefore, it has been found that although it is desirable to minimize the amount of lubricating oil supplied, reducing the amount of lubricating oil supplied causes the following new problems.

Information on the rotating speed (rotational speed) of the compressor is transmitted from the inverter 11 to the control device 13, and the control device 13 controls the flow rate adjusting valve 12 according to the rotating speed of the compressor to increase or decrease the amount of lubricating oil supplied to the compressor main body 3. However, when the lubricating oil amount is reduced, both a mass flow rate Qm kg/s and a volume flow rate Qv $m^3/s$ of the lubricating oil injected from the injection port 3*d* into the compression chamber are reduced. Therefore, an injection speed U m/s of the lubricating oil injected from the injection port (injection nozzle) 3*d* (cross-sectional area A $m^2$) is "Qv/A" and thus decreases.

The injection port 3*d* is provided on a lower side of the casing 3*a* having a large degree of freedom in handling. Therefore, the lubricating oil injected from the injection port 3*d* into the compression chamber is injected upward against gravity. When the amount of the lubricating oil decreases, the injection speed of the lubricating oil injected from the injection port 3*d* also decreases. Therefore, there is a problem that the lubricating oil cannot sufficiently reach the wall surface of the screw rotor forming the compression chamber, and the lubricating oil cannot be sufficiently supplied to the entire compression chamber.

In addition, the injection port 3*d* is usually configured by a plurality of injection nozzles, and creates an impingement jet and supplies the impingement jet as fine oil droplets to the compression chamber. However, when the amount of supplied lubricating oil decreases, there is also a problem that the injection speed of the injected lubricating oil decreases when the impingement jet is created by the plurality of injection nozzles, and sufficient droplet characteristics, that is, sufficiently fine droplets cannot be obtained.

In order to solve these problems, in the present invention, the compressed gas is supplied to the oil supply pipe (liquid injection path) 9 according to the amount of the lubricating oil (coolant) supplied to the compressor main body 3, and the volume flow rate of the gas-liquid mixed fluid obtained by combining the lubricating oil and the compressed gas supplied to the compressor main body 3 is controlled to be substantially constant regardless of the rotating speed of the compressor and is supplied to the compressor main body 3.

Specifically, as illustrated in FIG. 1, a gas-liquid mixing unit 14 is provided on the downstream side of the flow rate adjusting valve 12 in the oil supply pipe 9, and a compressed gas supply path (return air pipe) 15 for guiding a part of the compressed gas separated by the oil separator 4 is connected to the gas-liquid mixing unit 14. The compressed gas supply path 15 is provided with a flow rate adjusting valve (second flow rate adjusting valve) 16, and the flow rate adjusting valve 16 is controlled by the control device 13 such that the amount of compressed gas supplied from the compressed gas supply path 15 to the oil supply pipe 9 increases as the amount of lubricating oil (coolant) supplied to the compressor main body 3 decreases.

That is, in the present embodiment, the compressed gas having substantially the same volume flow rate as the changing volume flow rate of the lubricating oil is supplied to the oil supply pipe 9 according to the change amount of the volume flow rate of the lubricating oil supplied to the compressor main body 3, and the compressed gas is supplied to the compressor main body 3 so that the volume flow rate of a gas-liquid mixed flow (bubble flow) obtained by combining the lubricating oil and the compressed gas at the downstream of the gas-liquid mixing unit 14 becomes substantially constant.

In the present embodiment, a flow rate detector (flow meter) 17 that detects a volume flow rate is provided on the downstream side of the gas-liquid mixing unit 14, and the control device 13 controls the flow rate adjusting valve 12 provided in the oil supply pipe 9 and the flow rate adjusting valve 16 provided in the compressed gas supply path 15 based on a value of the volume flow rate detected by the flow rate detector 17.

That is, the control device 13 controls the flow rate adjusting valve 12 of the oil supply pipe 9 so as to adjust the amount of the lubricating oil supplied to the compressor according to the change in the rotational speed of the screw rotor of the compressor main body (compressor) 3. At this time, the control device 13 controls the flow rate adjusting valve 12 based on the value detected by the flow rate detector 17 so as to have a predetermined amount of lubricating oil according to the rotating speed. In addition, the flow rate adjusting valve 16 of the compressed gas supply path 15 is controlled according to the amount of the lubricating oil supplied to the compressor so that the volume flow rate of the gas-liquid mixed flow obtained by combining the lubricating oil and the compressed gas on the downstream side of the gas-liquid mixing unit 14 becomes substantially constant regardless of the change in the amount of the lubricating oil and is supplied to the compressor main body 3.

Specifically, by supplying compressed gas having substantially the same volume flow rate as the changing volume flow rate of lubricating oil to the oil supply pipe 9, the volume flow rate of the gas-liquid mixed flow supplied to the compressor is controlled so as not to change even when the rotating speed changes and the amount of lubricating oil supplied to the compressor decreases.

In the present embodiment described above, the load factor is changed by changing the rotating speed of the electric motor. However, as means for changing the load factor, for example, the electric motor may be set to a constant speed, and the intake air amount may be adjusted by the intake throttle valve 2.

FIG. 2 illustrates a main part of the compressor main body 3, and illustrates a situation where a bubble flow is injected into the compression chamber 3*e* from the injection port 3*d* formed on an inner surface of the casing (fixed wall) 3*a*. As illustrated in FIG. 2, the injection port 3*d* is formed in the casing 3*a* of the compressor main body 3, and a coolant flow path 3*f* is formed inside the casing 3*a* in order to guide the lubricating oil supplied from the oil supply pipe 9 (see FIG. 1) to the injection port 3*d*. The bubble flow (gas-liquid mixed flow) 20 generated in the gas-liquid mixing unit 14 is supplied to the coolant flow path 3*f*, and the bubble flow 20 is formed of oil and bubbles 21, and is jetted into the compression chamber 3*e* as oil droplets 22 from the injection port 3*d* provided in the casing 3*a*.

The injection ports 3*d* are usually provided at a plurality of locations (for example, a plurality of locations along the screw groove direction of the screw rotor or along the axial direction), and each injection port 3*d* includes a plurality of two injection nozzles 3*d*1 and 3*d*2 communicating with the compression chamber 3*e* and facing each other. The lubricating oil injected from the two directions collides with each other by the two injection nozzles 3*d*1 and 3*d*2, so that the lubricating oil is further diffused into the compression chamber 3*e* as fine oil droplets (droplets). The oil droplet 22 reaches the wall surface of the screw rotor (rotating wall) 3*g* of the compression chamber 3*e* to become an oil film 23, or scatters into the space in the compression chamber to take heat from the compressed air and the screw rotor 3*g* and cool them.

The coolant flow path 3*f* and the injection port 3*d* are generally provided on the lower side of the casing 3*a* having a large degree of freedom in handling, and the lubricating oil supplied to the coolant flow path 3*f* and injected from the injection port 3*d* into the compression chamber 3*e* is injected upward against gravity. When the amount of the lubricating oil supplied to the coolant flow path 3*f* decreases, the injection speed of the lubricating oil injected from the injection port 3*d* also decreases. However, in the present embodiment, even when the amount of the lubricating oil decreases, the lubricating oil is supplied to the compressor as the bubble flow mixed with compressed air so that the volume flow rate does not decrease.

Therefore, since a decrease in the injection speed of the lubricating oil injected from the injection port 3*d* can be suppressed, the lubricating oil can sufficiently reach the wall surface of the screw rotor 3*g* forming the compression chamber 3*e*. As a result, the lubricating oil can be sufficiently supplied to the entire compression chamber 3*e*, and lubrication and sealing between the rotors and between the rotor and the casing can be reliably performed.

In addition, since the injection speed of the lubricating oil injected from the injection port 3*d* can be maintained, sufficient droplet characteristics, that is, sufficiently fine droplets can be obtained by the impingement jet by the plurality of injection nozzles 3*d*1 and 3*d*2.

As described above, according to the present embodiment, since the volume flow rate of the bubble flow 20 can be kept constant even when the flow rate of the oil is changed according to the required cooling capacity according to the rotating speed of the compressor, the injection speed of the oil injected from the injection port 3*d* can be kept constant, and the oil droplets 22 can be made to have a particle diameter as designed, and the reaching distance of the oil droplets 22 can be sufficient, so that sealing performance and lubricity between the rotor and between the rotor and the casing can be maintained well while the required cooling capacity is secured. The bubble flow 20 can reduce the mass (oil amount) of the oil entering the compression chamber 3*e* while ensuring the volume flow rate, so that the power consumption can be reduced by reducing the oil stirring loss.

At the time of starting the compressor or the like, the pressure in the circulation path of the lubricating oil may become unstable, for example, when the pressure in the oil separator 4 becomes lower than the pressure in the compression chamber 3*e*. In order to prevent the gas and the lubricating oil in the compression chamber 3*e* from flowing back toward the oil supply pipe 9 and the compressed gas supply path 15 in such a case, in the present embodiment, as illustrated in FIG. 1, check valves 18 and 19 are provided between the first flow rate adjusting valve 12 and the gas-liquid mixing unit 14 and between the second flow rate adjusting valve 16 and the gas-liquid mixing unit 14, respectively. When the check valves 18 and 19 are provided in this manner, not only backflow from the compression chamber 3*e* can be prevented, but also backflow from the oil supply pipe 9 to the compressed gas supply path 15 side and backflow from the compressed gas supply path 15 to the flow rate adjusting valve 12 side of the oil supply pipe 9 can be prevented.

Next, the operation of the oil-cooled compressor of the present embodiment will be described.

The mixed fluid of the compressed air and the lubricating oil discharged from the compressor main body 3 flows into the oil separator 4, is separated into the compressed air and the lubricating oil (oil), and the separated compressed air is supplied to the demand destination. Since the separated oil has a high temperature due to compression heat, the separated oil is cooled by the oil cooler 7, then passes through the oil filter 8, and is guided to the flow rate adjusting valve 12.

The rotational speed of the electric motor 10 is output as an electric signal from the inverter 11 to the control device 13. In the control device 13, a relationship between the rotational speed and an appropriate oil supply amount to the compressor main body 3 is set in advance, and the control device 13 controls an opening degree of the flow rate adjusting valve 12 according to this relationship.

In particular, in a compressor or the like having a large-diameter rotor (rotating wall), the power consumption is large. Therefore, by reducing the oil supply amount as the compressor rotational speed decreases, the stirring loss of the lubricating oil can be reduced, and the power consumption reduction effect is large. Therefore, the control device 13 controls the flow rate adjusting valve 12 so as to decrease the oil supply amount as the compressor rotational speed decreases, and on the contrary, controls the flow rate adjusting valve 12 so as to increase the oil supply amount as the rotational speed increases.

In the present embodiment, the flow rate adjusting valve 16 of the compressed gas supply path 15 is also controlled according to the control of the flow rate adjusting valve 12 or simultaneously with the control of the flow rate adjusting valve 12, and the control is performed such that the volume flow rate of the bubble flow (gas-liquid mixed flow) supplied from the gas-liquid mixing unit 14 to the coolant flow path 3*f* is kept constant.

The bubble flows of the oil and the air are separated into the air and the oil again by the oil separator 4 after the compressed air and the like are cooled in the compressor main body 3. Therefore, the oil from which the air bubbles are removed flows into the flow path of the oil cooler 7, and there is no deterioration in heat transfer performance due to air bubble mixing.

In addition, power for operating the flow rate adjusting valves 12 and 16 and the flow rate detector 17 is supplied from the inverter 11, for example.

The gas-liquid mixing unit 14 is provided between the oil filter 8 and the compressor main body 3 in the oil supply pipe 9, and is a three-port gas-liquid mixing unit including at least two inlets and one outlet. The flow rate detector 17 is provided on the outlet side (compressor main body 3 side) of the gas-liquid mixing unit 14, and the flow rate adjusting valve 12 is disposed in the oil supply pipe 9 on the first inlet side (oil filter 8 side) of the gas-liquid mixing unit 14. The flow rate adjusting valve 16 is provided on the second inlet side (compressed gas supply path 15 side) of the gas-liquid mixing unit 14.

When the flow rate adjusting valve 16 on the compressed gas side is opened during the circulation of the oil, the oil and the air are mixed in the gas-liquid mixing unit 14, and a bubble flow (gas-liquid mixed flow) is formed at the outlet of the gas-liquid mixing unit 14. The flow rate detector 17 and the two flow rate adjusting valves 12 and 16 are connected to the control device 13, and the output of the flow rate detector 17 can be monitored from the control device 13, and the opening degrees of the two flow rate adjusting valves 12 and 16 can be adjusted to adjust the volume flow rate of the bubble flow to an arbitrary or predetermined flow rate.

In the present embodiment, since the check valves 18 and 19 are provided, even when the pressure of the gas-liquid mixing unit 14 is higher than the pressure on the flow rate adjusting valves 12 and 16 side, backflow to the flow rate adjusting valves 12 and 16 side can be prevented.

It is also possible to control the flow rate while controlling the differential pressure by using a pressure gauge and a pressure control valve instead of the flow rate adjusting valves 12 and 16.

Hereinafter, a specific example of the gas-liquid mixing unit 14 will be described with reference to FIGS. 3 to 7.

Figure 3:
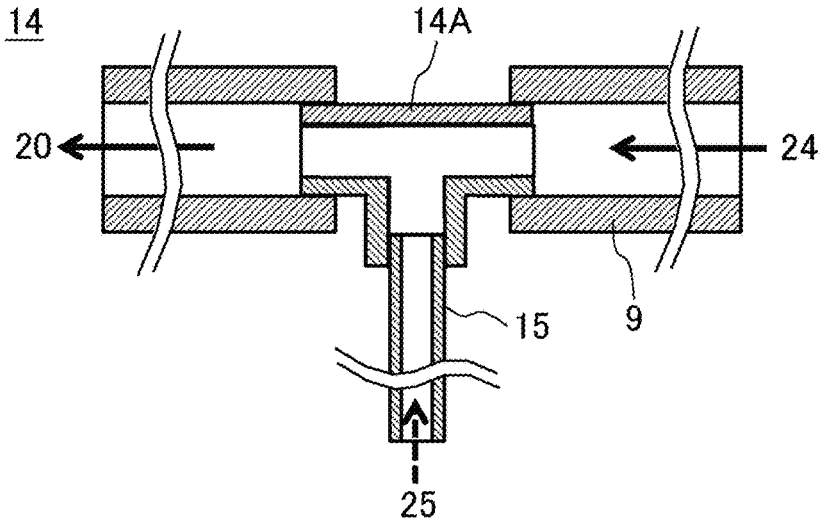
FIG. 3 is a cross-sectional view illustrating an example in which a T-type pipe is used as a gas-liquid mixing unit illustrated in FIG. 1.

FIG. 3 is a cross-sectional view illustrating an example in which a T-type pipe 14A which is a T-shaped pipe component including three ports is used as the gas-liquid mixing unit 14. A reference numeral 24 denotes lubricating oil supplied from the oil supply pipe 9 to a first inlet of the T-type pipe 14A and a reference numeral 25 denotes compressed air supplied from the compressed gas supply path 15 to a second inlet of the T-type pipe 14A. The lubricating oil and the compressed air are mixed in the T-type pipe 14A to form a bubble flow 20 and are supplied from an outlet of the T-type pipe 14A to the compressor main body 3 side.

The use of T-type pipe 14A can be configured inexpensively, but there is a possibility that the bubble flow 20 becomes non-uniform. Therefore, when an in-liquid injection nozzle is provided on the injection side of the compressed air, fine bubbles can be generated.

Figure 4:
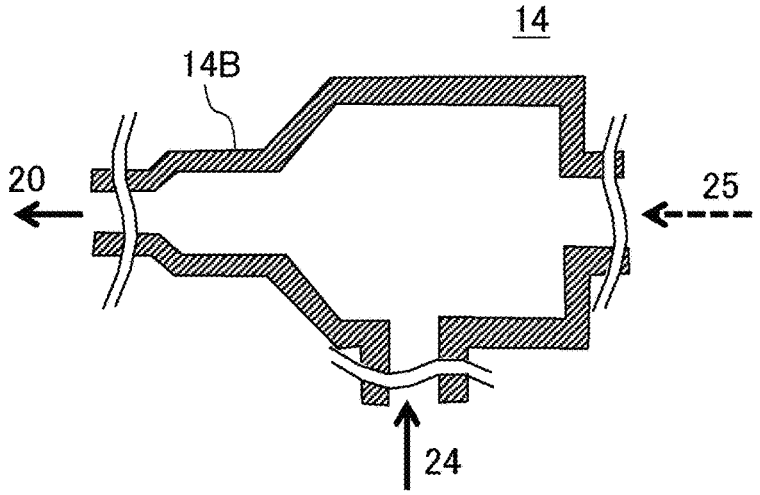
FIG. 4 is a cross-sectional view illustrating an example in which a two-fluid nozzle is used as the gas-liquid mixing unit illustrated in FIG. 1.

FIG. 4 is a cross-sectional view illustrating an example in which a two-fluid nozzle (gas-liquid mixer) 14B including three ports is used as the gas-liquid mixing unit 14. A reference numeral 24 denotes lubricating oil supplied from the oil supply pipe 9 to a first inlet of the two-fluid nozzle 14B and a reference numeral 25 denotes compressed air supplied from the compressed gas supply path 15 to a second inlet of the two-fluid nozzle 14B. The lubricating oil and the compressed air are mixed in the two-fluid nozzle 14B to form a bubble flow 20, and are supplied from an outlet of the two-fluid nozzle 14B to the compressor main body 3 side.

The two-fluid nozzle 14B is generally used to generate a spray of a trace amount of liquid with a large amount of high-pressure gas, but a bubble flow with a large amount of liquid can also be generated by adjusting the amount of oil and air.

Figure 5:
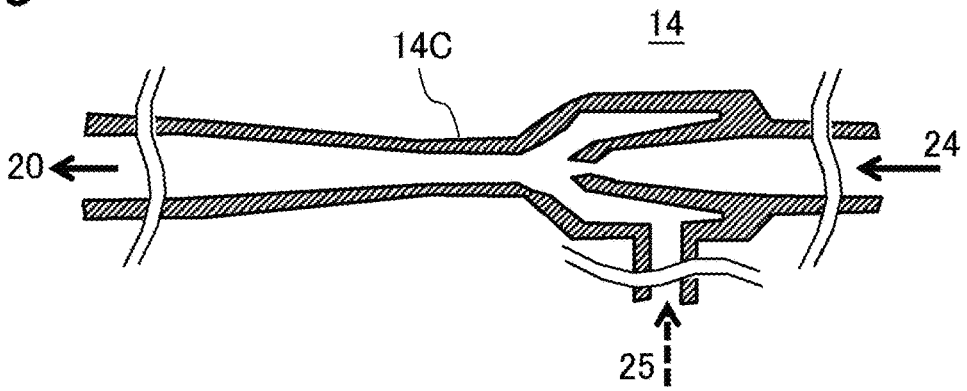
FIG. 5 is a cross-sectional view illustrating an example in which a liquid injection ejector is used as the gas-liquid mixing unit illustrated in FIG. 1.

FIG. 5 is a cross-sectional view illustrating an example in which a liquid injection ejector 14C including three ports is used as the gas-liquid mixing unit 14. A reference numeral 24 denotes lubricating oil supplied from the oil supply pipe 9 to a first inlet of the liquid injection ejector 14C, and a reference numeral 25 denotes compressed air supplied from the compressed gas supply path to a second inlet of the liquid injection ejector 14C. The lubricating oil and the compressed air are mixed in the liquid injection ejector 14C to generate a bubble flow 20, and are supplied from an outlet of the liquid injection ejector 14C to the compressor main body 3 side.

The liquid injection ejector 14C is frequently used as a gas-liquid disperser of a bubble column used for a chemical reaction, has good bubble dispersibility, and a relationship between gas holdup in a liquid and a flow rate of gas and liquid has been clarified, so that the function of the gas-liquid mixing unit 14 can be sufficiently exerted. However, a pressure loss may increase.

Figure 6:
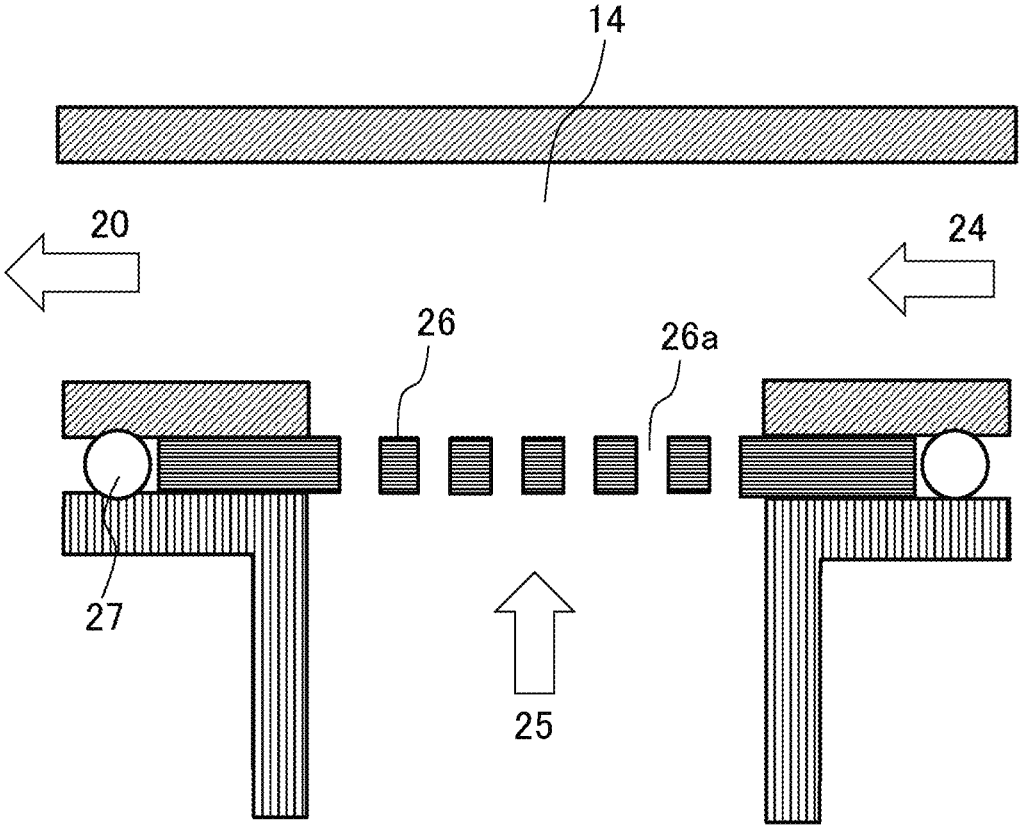
FIG. 6 is a cross-sectional view illustrating an example in which a porous plate is used as the gas-liquid mixing unit illustrated in FIG. 1.

An example in which the gas-liquid mixing unit 14 is configured using a porous plate (porous wall) will be described with reference to FIGS. 6 and 7. FIG. 6 is a cross-sectional view of the gas-liquid mixing unit 14, and FIG. 7 is a perspective view of a porous plate 26 illustrated in FIG. 6.

In this example, the porous plate 26 having a large number of holes 26*a* is provided between gas and liquid, that is, between the lubricating oil 24 flowing through the oil supply pipe 9 and the compressed air 25 flowing through the compressed gas supply path 15 connected to the gas-liquid mixing unit 14 provided in the oil supply pipe 9, and the lubricating oil and the compressed air are mixed via the porous plate 26 to generate the bubble flow 20. By providing a sealing material 27 such as an O-ring on an outer periphery of the porous plate 26 provided at a connection portion between the lubricating oil and the compressed air, sealing is performed so that the compressed gas and the lubricating oil do not leak to the outside.

In this example, since the gas is bubbled by the porous plate 26 and mixed with the lubricating oil, the bubble flow 20 is easily generated, but when a diameter of the hole 26*a* formed in the porous plate 26 is small, the pressure loss may increase.

Figure 7:
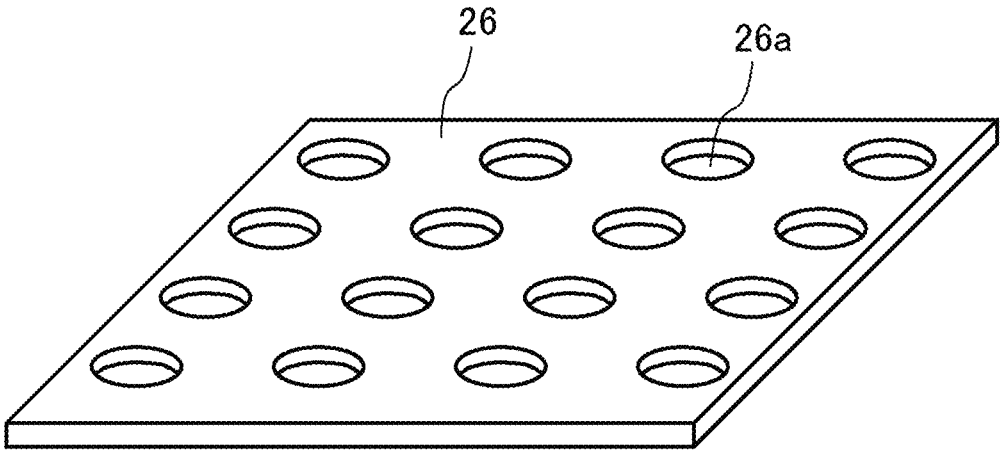
FIG. 7 is a perspective view of the porous plate illustrated in FIG. 6.

The porous plate 26 may be made of a punching metal as illustrated in FIG. 7, a sintered metal, a porous metal, or the like.

Figure 8:
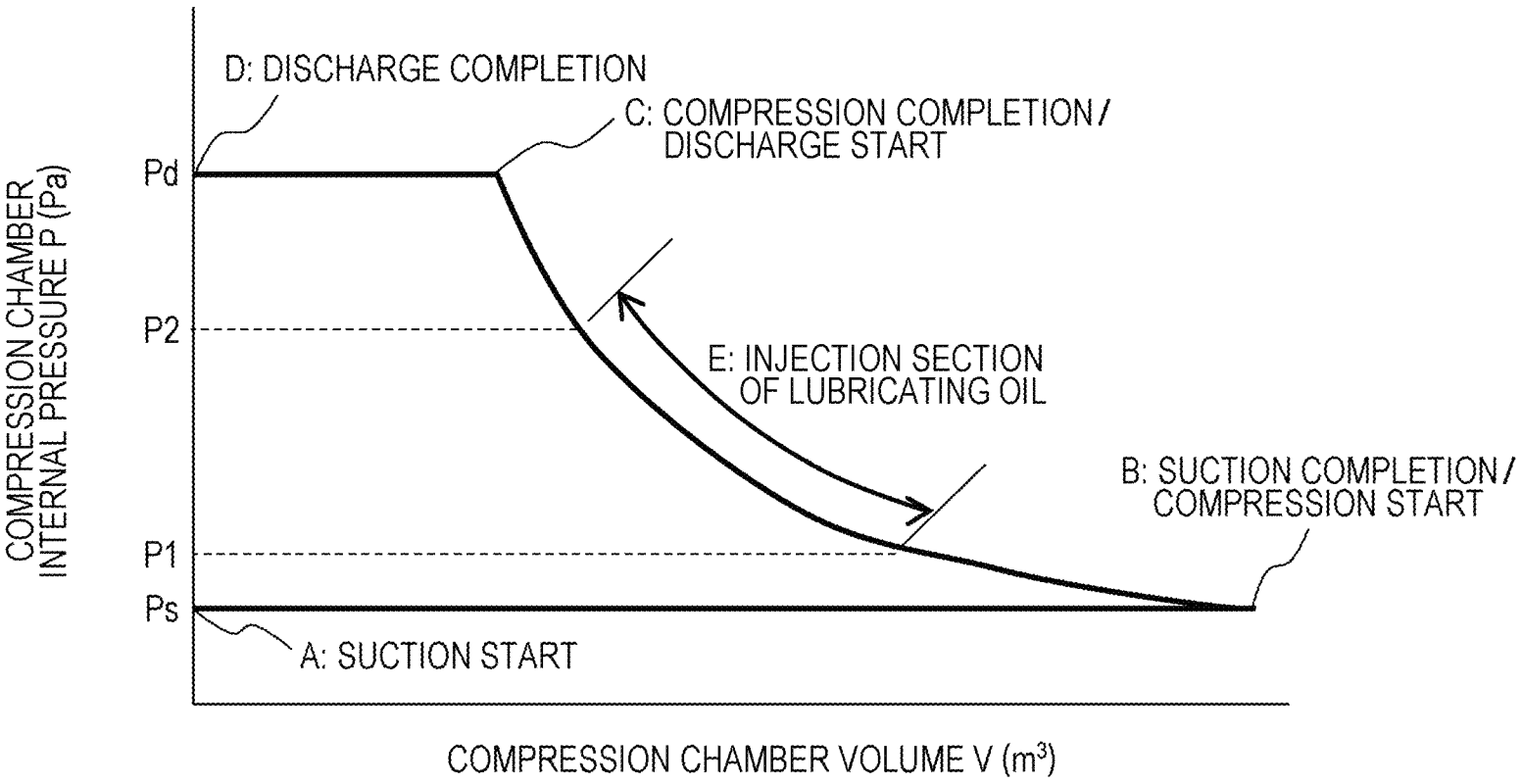
FIG. 8 is a pressure-volume curve diagram for explaining a relationship between a change in a compression chamber volume and a compression chamber internal pressure in the compressor main body illustrated in FIG. 1.

FIG. 8 is a pressure-volume curve diagram illustrating the relationship between the change in a compression chamber volume and a compression chamber internal pressure in the compressor main body 3 illustrated in FIG. 1, where a horizontal axis represents the compression chamber volume and a vertical axis represents the compression chamber internal pressure. Here, a case where the liquid-cooled rotary compressor is an oil-cooled screw compressor will be described as an example.

A rotary compressor such as a screw compressor operates in the order of ABCD in FIG. 8. The air that has passed through the intake throttle valve 2 illustrated in FIG. 1 starts to be sucked into a compression chamber inlet of the compressor main body 3 when the compression chamber inlet is opened (A). The pressure at this time is a suction pressure Ps. As the screw rotor (rotor) rotates, the volume increases. When the volume reaches the maximum volume, the inlet of the compression chamber is closed to complete suction, and at the same time, compression starts (B). Thereafter, with the rotation of the rotor, the volume of the compression chamber decreases, compression proceeds, and pressurized heat is generated. Therefore, in order to cool the compressed air, the lubricating oil is injected into the compression chamber from the injection port 3*d*, and the compression heat is absorbed into the lubricating oil. When the compression chamber opens to the discharge port, the compression is completed and the discharge is started (C). The pressure at this time is a discharge pressure Pd. The compressed air compressed to the pressure Pd is discharged from the discharge port together with the lubricating oil along with the rotation of the rotor, and the discharge is completed at a position D. Thereafter, the steps A to D are repeated again along with the rotation of the rotor. A to B are suction steps, B to C are compression steps, and C to D are discharge steps.

The lubricating oil is injected into the compression chamber from the injection port 3*d* in order to cool the compressed air heated by the increase in pressure in the compression step. In the example illustrated in FIG. 8, a section E is an injection section of the lubricating oil. Since the pressure in the injection section is P1 to P2 lower than the discharge pressure Pd, and the pressure in the oil separator 4 is Pd, the lubricating oil can be injected into the compression chamber by the pressure difference. In order to inject the lubricating oil, a pressure higher than the compression chamber pressure P2 is required, and in order to control the injection amount of the oil, the flow rate adjusting valves 12 and 16 are controlled by the control device 13 of FIG. 1. It is still more preferable that a pressure gauge is further provided on the downstream side of the flow rate detector 17 illustrated in FIG. 1, and the pressure value is read by a control device to perform feedback control.

FIGS. 9A to 9J are schematic time transition diagrams of a physical quantity for explaining a relationship between a change in a load factor (rotating speed) in the liquid-cooled rotary compressor illustrated in FIG. 1 and a flow rate, a calorific value, and the like of compressed air. In the present embodiment, a part of the compressed air after the oil is separated by the oil separator 4 is supplied to the gas-liquid mixing unit 14 of the oil supply pipe 9, and this air is referred to as return air.

In each graph (time transition diagram) (a) to (j), a horizontal axis represents elapsed time, and a vertical axis represents each physical quantity. The graph (a) illustrates a situation in which the compressor is driven to start rotation of the rotor, and the rotating speed is controlled to reach the rating, then gradually decrease, then increase, and return to the rating. The compressed air amount and the calorific value in the graph (b) are proportional to the increase or decrease in the rotating speed in the graph (a). The same applies to the required flow rate of the lubricating oil (coolant) in the graph (c).

Here, the flow rate of the lubricating oil also increases and decreases in proportion to the increase and decrease of the rotating speed. However, when return air having a volume flow rate substantially equal to the decrease of the lubricating oil is supplied to the lubricating oil as illustrated in the graph (d), the total volume flow rate of the generated bubble flow can be kept constant as illustrated in the graph (e). As a result, as illustrated in the graph (f), the injection speed of the oil droplet (droplet) can also be kept constant regardless of the increase or decrease in the rotating speed.

As illustrated in the graphs (g) and (h), the mass flow rate of the lubricating oil injected into the compression chamber increases or decreases in proportion to the rotating speed, and the mass flow rate of the return air (compressed air) injected increases or decreases in inverse proportion. However, since the density of the air is about 1/100 of the oil, the influence of the increase in the mass flow rate of the air is small, and the mass flow rate of the bubble flow can be substantially regarded as the mass flow rate of the oil as illustrated in the graph (i). Therefore, in the present embodiment, the stirring loss with respect to the oil can be proportional to the increase or decrease of the rotating speed as illustrated in the graph (j) while maintaining the injection speed of the oil droplet (liquid droplet).

In the example of FIGS. 9A to 9J, the rotating speed is changed in a stepwise manner, but even when the rotating speed is changed in a curved manner, control can be similarly performed. However, it is necessary to perform control in consideration of a time delay between the rotating speed and the flow rate.

As described above, according to the present embodiment, when the compressor rotating speed decreases, the opening degree of the flow rate adjusting valve 12 is reduced to reduce the volume flow rate of the lubricating oil (coolant), and compressed air of a volume flow rate substantially equal to the reduced volume flow rate of the lubricating oil is added to the lubricating oil by increasing the opening degree of the flow rate adjusting valve 16. Therefore, the volume flow rate of the gas-liquid mixed flow (bubble flow) supplied to the compressor can be kept constant. Therefore, since the injection speed of the oil droplet injected from the injection port to the compression chamber can be maintained at a necessary value, lubrication and sealing between the rotors and between the rotor and the casing can be sufficiently performed.

Meanwhile, since compressed air having a low density is mixed in the gas-liquid mixed fluid, the mass flow rate can be reduced while maintaining the volume flow rate. Therefore, since the stirring loss of the lubricating oil can be reduced, the power consumption can be reduced. In addition, since the mass flow rate of the lubricating oil can be reduced, the cooling capacity of the oil cooler for cooling the lubricating oil can also be reduced, and for example, the power consumption can be reduced by reducing a speed of a cooling fan.

In addition, when the coolant is a carbon-containing lubricating oil, the injection speed can be maintained even when the amount of lubricating oil is reduced by a configuration in which the compressed gas is mixed and injected into the compression chamber as a gas-liquid mixed flow even at the time of rated operation. Therefore, it is possible to minimize the amount of carbon-containing lubricating oil used, and it is possible to contribute to decarbonization by reducing the lubricating oil and environmental conservation.

The present invention is particularly suitable for an oil-cooled screw compressor in which the compressor main body 3 includes the casing 3*a* and the pair of male and female screw rotors (screw type rotors) 3*g* rotatably arranged in the casing 3*a*, a space surrounded by the screw rotor 3*g* and the casing 3*a* becomes the compression chamber 3*e*, and the volume of the compression chamber 3*e* decreases with the rotation of the screw rotor 3*g* to compress air.

However, the present invention is not limited to the above-described embodiments, and includes various modifications. For example, the present invention can be similarly applied to a water injection screw compressor that injects water instead of oil. Further, the compressor main body is not limited to the screw compressor, the compressor main body 3 may be a scroll compressor, and a rotary compressor that injects liquid into the compression chamber can be similarly applied.

In addition, the above-described embodiments have been described in detail in order to describe the present invention in an easy-to-understand manner, and are not necessarily limited to those having all the described configurations.

What is claimed is:

1. A liquid-cooled rotary compressor including a compressor main body that forms a compression chamber by a fixed wall and a rotor and a liquid injection path that injects a coolant into the compression chamber and adjusts a discharge flow rate by changing a load factor of the compressor main body, the liquid-cooled rotary compressor comprising:

a liquid amount adjusting unit that adjusts an amount of the coolant supplied from the liquid injection path to the compressor main body according to a change in the load factor of the compressor main body; and a compressed gas supply path configured to supply compressed gas to a downstream side of the liquid amount adjusting unit in the liquid injection path, wherein the compressed gas is supplied from the compressed gas supply path to the liquid injection path according to the amount of the coolant supplied to the compressor main body, wherein the fixed wall is a casing of the liquid-cooled rotary compressor, wherein the casing is provided with a suction port through which gas is sucked, a discharge port through which compressed gas is discharged, and an injection port through which liquid is injected into the compression chamber, wherein the liquid injection path is connected to the injection port, wherein the liquid injection path includes a first flow rate adjusting valve as the liquid amount adjusting unit and a gas-liquid mixing unit provided on a downstream side of the first flow rate adjusting valve, wherein the compressed gas supply path is connected to the gas-liquid mixing unit, and wherein a second flow rate adjusting valve is provided in the compressed gas supply path.

2. The liquid-cooled rotary compressor according to claim 1, wherein the amount of the compressed gas supplied from the compressed gas supply path to the liquid injection path increases as the amount of the coolant supplied to the compressor main body decreases.

3. The liquid-cooled rotary compressor according to claim 2, wherein a compressed gas having a volume flow rate substantially a same as a volume flow rate of the coolant that changes is supplied to the liquid injection path according to a change amount of a volume flow rate of the coolant supplied to the compressor main body, and a volume flow rate of a gas-liquid mixed fluid obtained by combining the coolant and the compressed gas is made substantially constant and supplied to the compressor main body.

4. The liquid-cooled rotary compressor according to claim 1, further comprising:

a gas-liquid separator that separates a gas and a liquid from a mixed fluid of a compressed gas and a coolant discharged from the discharge port; and a liquid cooler that cools the liquid separated by the gas-liquid separator, wherein the liquid injection path constitutes a coolant circulation path for supplying the coolant cooled by the liquid cooler to the injection port, and a part of the compressed gas separated by the gas-liquid separator is supplied to the gas-liquid mixing unit via the compressed gas supply path.

5. The liquid-cooled rotary compressor according to claim 4, further comprising a control device that controls a first flow rate adjusting valve provided in the liquid injection path and a second flow rate adjusting valve provided in the compressed gas supply path, wherein the control device controls the first flow rate adjusting valve of the liquid injection path to adjust an amount of liquid to be supplied to the compressor main body according to a change in a rotational speed of the rotor, and controls the second flow rate adjusting valve of the compressed gas supply path according to an amount of liquid to be supplied to the compressor.

6. The liquid-cooled rotary compressor according to claim 5, wherein a flow rate detector configured to detect a volume flow rate is provided on a downstream side of the gas-liquid mixing unit in the liquid injection path, and the control device controls the first flow rate adjusting valve provided in the liquid injection path and the second flow rate adjusting valve provided in the compressed gas supply path based on the volume flow rate detected by the flow rate detector.

7. The liquid-cooled rotary compressor according to claim 4, wherein the liquid-cooled rotary compressor is an oil-cooled screw compressor, the rotor is a screw rotor, the gas compressed in the compression chamber is air, and the liquid injected into the compression chamber is lubricating oil.

8. The liquid-cooled rotary compressor according to claim 4, wherein a first check valve that prevents backflow from the gas-liquid mixing unit toward the first flow rate adjusting valve is provided between the gas-liquid mixing unit and the first flow rate adjusting valve in the liquid injection path, and a second check valve that prevents backflow from the gas-liquid mixing unit toward the second flow rate adjusting valve is provided between the gas-liquid mixing unit and the second flow rate adjusting valve in the compressed gas supply path.

9. The liquid-cooled rotary compressor according to claim 1, wherein the gas-liquid mixing unit mixes the liquid from the liquid injection path and the gas from the compressed gas supply path to generate a bubble flow.

10. The liquid-cooled rotary compressor according to claim 9, wherein the gas-liquid mixing unit is configured using any one of a T-type pipe, a two-fluid nozzle, and a liquid injection ejector, or a porous plate.

* * * * *